US007003220B2

(12) United States Patent
Gerhardinger

(10) Patent No.: US 7,003,220 B2
(45) Date of Patent: Feb. 21, 2006

(54) QUARTZ HEATER

(75) Inventor: Peter F. Gerhardinger, Maumee, OH (US)

(73) Assignee: Engineered Glass Products, LLC, Chicago, IL (US)

( * ) Notice: Subject to any disclaimer, the term of this patent is extended or adjusted under 35 U.S.C. 154(b) by 0 days.

(21) Appl. No.: 10/990,699

(22) Filed: Nov. 17, 2004

(65) Prior Publication Data

US 2005/0087525 A1 Apr. 28, 2005

Related U.S. Application Data

(63) Continuation of application No. 10/695,702, filed on Oct. 29, 2003, now Pat. No. 6,868,230.

(60) Provisional application No. 60/426,779, filed on Nov. 15, 2002.

(51) Int. Cl.
*F24H 1/10* (2006.01)

(52) U.S. Cl. ..... 392/483; 392/465; 219/540

(58) Field of Classification Search ..... 392/465, 392/466; 219/540, 541, 543, 538, 542

See application file for complete search history.

(56) References Cited

U.S. PATENT DOCUMENTS

| | | | |
|---|---|---|---|
| 2,022,314 | A | 11/1935 | Heyroth et al. |
| 3,699,309 | A | 10/1972 | Eck |
| 4,180,723 | A | 12/1979 | Szupillo |
| 4,395,619 | A | 7/1983 | Harigai |
| 4,498,923 | A | 2/1985 | Cline |
| 4,531,047 | A | 7/1985 | Canfield et al. |
| 4,882,203 | A | 11/1989 | Witmer |
| 5,155,798 | A | 10/1992 | Van Denend |
| 5,781,692 | A | 7/1998 | Wagner |
| 5,838,878 | A | 11/1998 | Jane et al. |
| 5,915,072 | A | 6/1999 | Campbell et al. |
| 6,037,574 | A | 3/2000 | Lanham et al. |
| 6,059,986 | A | 5/2000 | Jung et al. |
| 6,284,312 | B1 | 9/2001 | Chandra et al. |
| 6,376,816 | B1 | 4/2002 | Cooper et al. |
| 2003/0127452 | A1 | 7/2003 | Gerhardinger et al. |

*Primary Examiner*—Thor S. Campbell
(74) *Attorney, Agent, or Firm*—Marshall & Melhorn LLC

(57) ABSTRACT

A quartz heater is provided for heating fluids or objects. The heater comprises a member, for example, a quartz glass tubular or non-tubular member, with a low-emissivity conductive coating that produces heat when connected to external power. The fluid can be heated as it passes through the tubular member. If the member is not completely coated, then heat radiates toward the center of the member, pass through its uncoated portion, and then onto objects for heating.

16 Claims, 2 Drawing Sheets

QUARTZ HEATER

RELATED APPLICATIONS

This application is a continuation application of U.S. patent application Ser. No. 10/695,702, filed Oct. 29, 2003 now U.S. Pat. No. 6,868,230, that claims benefit of U.S. Provisional Patent Application Ser. No. 60/426,779, filed Nov. 15, 2002, which applications are incorporated herein in their entirety.

BACKGROUND OF THE INVENTION

The present invention generally relates to a heater assembly and, more particularly, to a vacuum insulated quartz tube heater assembly for heating fluids and objects.

The use of quartz glass to encase a heater element is known in the art, since quartz glass has the ability to sustain the high temperatures that are generated by the heater, while the quartz glass is relatively chemically inactive. Typically, electrically resistive wires, ribbons, and coils have been used as heater elements within quartz heaters to generate the required heat.

Recently, conductive metal oxide films (coatings) have been employed as heating elements, where the films are generally disposed on glass. One of the methods for depositing the films has been to spray coat the films onto the glass. More recently, the depositing of the coatings has improved, for example, through the use of chemical vapor deposition (CVD).

An application of quartz glass that would benefit from the employment of the use of the conductive coating as a heating element would be a quartz glass heater for the heating of a fluid or other material as the fluid would flow through the quartz glass heater. In such a heater, the heating element would need to elevate the fluid temperature as the fluid would pass through the heater.

If a quartz glass heater, using a thin film conductive coating, could be constructed it would be an improvement over the conventional heater element, since the conventional wire, ribbon, or coil elements are more costly, more bulky, and add weight to the heater assembly.

However, achieving such a deposition on curved quartz glass has proven to be difficult. This is due to the fact that the conductive coating must be uniformly disposed upon the quartz glass in such a manner as to properly electrically section off the conductive coating, while achieving a necessary resistive load for the desired output power.

In addition, expanding the adoption of this technology is hampered by the complexity of safely, reliably, and cost effectively combining glass and electricity. Because of the high temperatures that are generated by the heater, the chemical reactivity of the parts of the heater, along with the atmosphere within the heater, become important factors affecting the reliability of the heating assembly.

If the parts and/or atmosphere within the heater assembly are not properly chosen the high heat will cause the materials and the atmosphere to interact and lose their functionality, which will shorten the life of the heater assembly. In the past, conventional quartz glass heating elements have been disposed within a vacuum. As a result, the quartz glass, which has a low chemical reactivity, the vacuum/atmosphere within the quartz heater, and the various parts within conventional quartz glass heaters would have to be properly chosen in order to provide better reliability for the heater assembly.

Thus, those skilled in the art continue to seek a solution to the problem of how to provide a better vacuum insulated quartz glass heater assembly.

SUMMARY OF THE INVENTION

The present invention relates to a vacuum insulated heater assembly that is used for heating fluids and objects. The heater assembly includes an inner member (heating element), for example, a quartz glass tube, where at least a portion of a major surface has a conductive coating disposed thereon. Electrical connection to the conductive coating can be made by at least two connection means (connections) that are disposed onto and are in electrical contact with the conductive coating. The connection means are disposed in such a manner as to define a set of parallel heating sections that provide the desired heating elements for the heater assembly. Consequently, an external power source is electrically connected to the connection means.

At least two end caps, each with a major inner member void defined within, are disposed on separate end portions of an outer member, for example, a quartz glass tube. The inner member is positioned within the outer member and mechanically attached to and extending through the end caps' major voids. In addition, the end caps have minor voids defined within that provide wire pathways, and vacuum drawing and sealing means for drawing and sealing a vacuum within the space defined between the outer and inner elements.

With the inner member having an axial void defined therethrough, the heater assembly would be used to heat material, for example, fluids, as they would flow through the axial void of the inner quartz glass tube. If the major surface of the inner member is not completely coated, then the heater assembly can be used to heat objects.

Further advantages of the present invention will be apparent from the following description and appended claims, reference being made to the accompanying drawings forming a part of a specification, wherein like reference characters designate corresponding parts of several views.

DETAILED DESCRIPTION OF THE PREFERRED EMBODIMENTS

Figure 1:
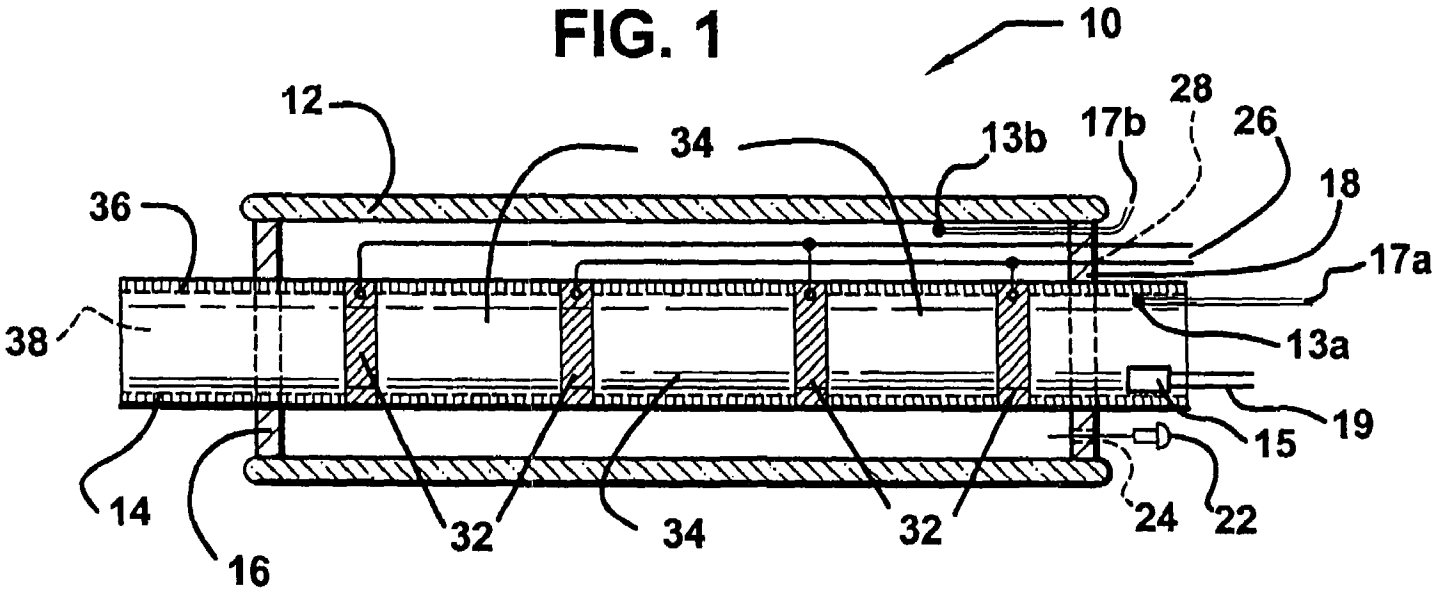
FIG. 1 is a partial side/partial cross-sectional view, taken in the direction of the arrows along the section line 1—1 of FIG. 2, of a vacuum insulated heater assembly with a tubular inner member in accordance with the present invention.

In general, the present invention involves the use of a vacuum insulated heater assembly 10, as shown in FIG. 1, for heating fluids and objects. Shown in a side view is an inner member 14 (heating element), for example, a quartz glass tube. Provided thereon is a conductive coating 34, for example, a doped metal (tin) oxide, like a fluorine doped tin oxide, that has been disposed on at least a portion of a major surface 36 of the inner member 14. A special rotating fixture (not shown) can be used to rotate the inner quartz glass tube 14 in a chemical spray booth, as one method of deposition of the conductive coating 34, where nominal sheet resistance of approximately 25 ohms per square can be attained. Alternate methods of deposition could be conductive coating chemical vapor deposition (CVD) or spray pyrolysis.

At least two connection means 32 (connectors), for example, compression fittings with a conductive wire mesh or conductive metal bus bars, for example, ceramic silver frit or sprayed metal copper, could be disposed onto and placed in electrical contact with the conductive coating 34 (see U.S. Provisional Patent Applications Ser. No. 60/339,409, filed Oct. 26, 2001, and Ser. No. 60/369,962, filed Apr. 4, 2002, and U.S. Utility patent application Ser. No. 10/256,391, filed Sep. 27, 2002, which applications are included herein by reference), wherein heating head and mask apparatus are utilized to dispose metal bus bars on electrically conductive coatings 34.

As additional and approximately equally spaced coating connection means 32 are added, sets of parallel heating sections are defined that lower the overall resistance and consequently increase the heat generation for a given power supply (not shown). Note that for a given voltage and size of inner member 14, the heat (Q) generated is directly proportional to the number (n) of equal parallel resistors (heat sections). For example, six equal heat sections will generate approximately three times the amount of heat that two equal heat sections will generate rate (i.e., $Q\alpha n$). Note, however, that unequal heat sections are within the spirit and scope of the present invention.

As a result, the present invention provides precise heating elements for the vacuum insulated heater assembly 10. Consequently, the connection means 32 are electrically connected to conduction means 26, for example, heater wires, and to an external electrical power source for powering the vacuum insulated heater assembly 10.

The inner quartz glass tube 14 is mechanically attached to and extends through major end cap voids in at least two end caps 16, 18 (shown in FIG. 1 in a cross-sectional view, taken in the direction of the arrows along the section line 1—1 of FIG. 2), for example, frit glass disks. The assembly of the inner quartz glass tube 14 and the end caps 16, 18 is positioned within an outer member 12 (shown in FIG. 1 in a cross-sectional view, taken in the direction of the arrows along the section line 1—1 of FIG. 2), for example, a quartz glass tube 12, where the end caps 16, 18 make mechanical contact with two end portions of the outer quartz glass tube 12. With a sealing substance, for example, solder frit, having been disposed on the end caps 16, 18, the assemblage of the outer quartz glass tube 12, the end caps 16, 18, and the inner quartz glass tube 14 is fired and sealed in an annealing oven.

The end caps 16, 18 would also have wiring voids 28 defined therewithin, in order to provide a pathway for the heater wiring 26, and a vacuum void 24 defined therewithin, in order to draw a vacuum within the space defined between the outer quartz glass tube 12 and the inner quartz glass tube 14. At least one vacuum grommet 22 would be used to seal and maintain the vacuum.

The composition of the heater wires 26, the outer quartz glass tube 12, inner quartz glass tube 14, the end caps 16, 18, the connection means 32, the conductive coating 34, and the vacuum grommet 22 are chosen to increase the reliability of the vacuum insulated heater assembly 10. This is desirable since reliability diminishes as a result of the high heating conditions in and around the heater, which tends to accelerate chemical reactions among the materials that make up the vacuum insulated heater assembly 10. In addition, the vacuum is drawn within the space between the outer quartz glass tube 12 and the inner quartz glass tube 14 in order to minimize the ability for the aforementioned parts to chemically interact with the atmosphere that might exist within the vacuum insulated heater assembly 10.

Figure 2:
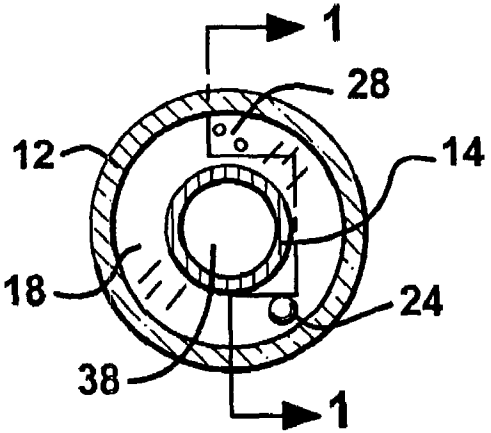
FIG. 2 is an end view of the vacuum insulated heater assembly of FIG. 1.

FIG. 2 illustrates an end view of the vacuum insulated heater assembly 10 of FIG. 1, where the inner quartz glass tube 14 is concentric within the outer quartz glass tube 12. The end cap 18 mechanically attaches to and seals the inner quartz glass tube 14 within the outer quartz glass tube 12. The inner quartz glass tube void 38, vacuum void 24, and the wiring voids 28 are also shown in FIG. 2.

It should be appreciated that the present invention may be practiced where the outer quartz glass tube 12 has a cross-section other than tubular, the cross-section of the inner quartz glass tube 14 may not be tubular or circular, for example, a curved piece of glass or a cross sectional shape other than circular, the end caps 16, 18 are not disks or rings, the inner quartz glass tube 14 is not concentric within the outer quartz glass tube 12, and/or an inert gas occupies the space between the inner member 14 and outer member 12.

Thus a preferred embodiment of the present invention provides the quartz glass heater 10 where the fluid to be heated is inside the tube 14 and the heat source 34 is outside of the tube 14, and the space between the two tubes 12 and 14 is evacuated. Due to the low emissivity of the coating 34, heat that is generated by electrical current being conducted through the coating 34 radiates into the inner member 14 but radiates very little heat directly from the coating 34 into the space adjacent to the coating 34 that is between the inner member 14, and the outer member 12. The coating 34 thus acts as a radiation barrier. In order to heat a fluid, the fluid flows through the inner member void 38 and heat radiates from the coating 34 toward the center of the inner member 14 thus heating the fluid flowing through the inner member void 38. In effect, the very efficient insulation provided by the space between the tubes 12 and 14 and the above stated properties of the low emissivity coating 34 is similar to a thermos bottle type of construction.

Figure 3:
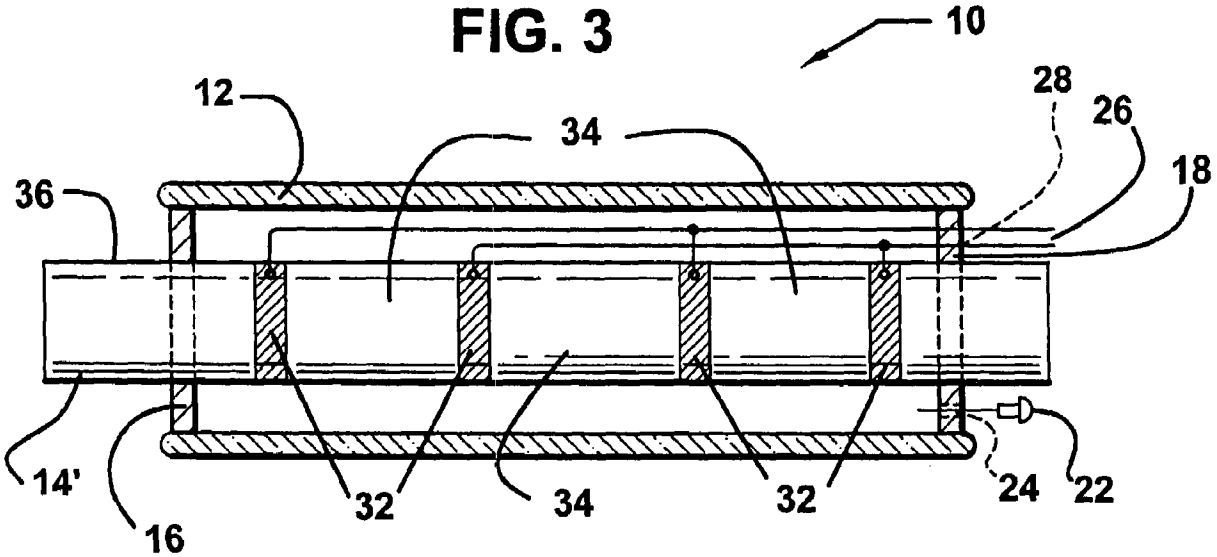
FIG. 3 is a partial side/partial cross-sectional view, taken in the direction of the arrows along the section line 3—3 of FIG. 4, of a vacuum insulated heater assembly with a non-tubular inner member in accordance with the present invention.
Figure 4:
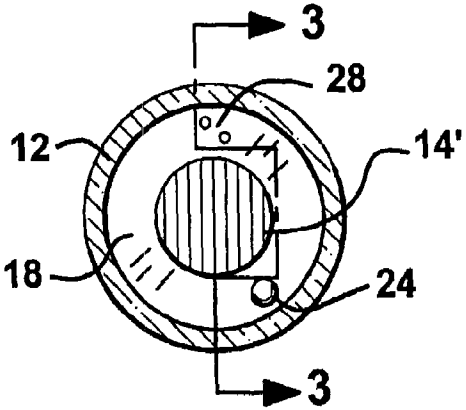
FIG. 4 is an end view of the vacuum insulated heater assembly of FIG. 3.

In order to heat objects, the shape of the inner member 14' (see FIGS. 3 and 4) need not be tubular and the electrically connected coating 34 may not be deposited on a large portion of the major surface 36, as would generally be the case in the above-mentioned fluid heater assembly 10. This would result in the heat radiating through the inner member 14' and then away from the inner member 14' in those portions of the inner member 14' where there was no coating 34 on the major surface 36, into the space between the inner member 14' and the outer member 12, through the outer member 12, and on to the object to be heated.

In application, and as shown in FIG. 1, the heating of the vacuum insulated heater assembly 10 may be controlled by way of a conventional temperature sensor 13*a* with associated conduction means 17*a* in the fluid stream, a temperature sensor 17*b* with associated conduction means 17*b* attached to a wall of the outer quartz glass tube 12, a simple flow switch 15 with associated conduction means 19 to energize the heater circuit when fluid is flowing, or other means conventional in the art.

In accordance with the provisions of the patent statutes, the principles and modes of operation of this invention have been described and illustrated in its preferred embodiments. However, it must be understood that the invention may be practiced otherwise than specifically explained and illustrated without departing from its spirit or scope.

What is claimed is:

1. A heating element, comprising:

a member having a major surface;

a conductive coating disposed on at least a portion of the major surface of the member; and annular connections disposed onto and in electrical contact with the conductive coating, the annular connections defining contiguous annular heating sections that are only electrically parallel to one another, such that for a given voltage and size of the member, the heat generated is directly proportional to the number of the contiguous annular heating sections.

2. The heating element of claim 1, wherein the contiguous annular heating sections are approximately equal in size.

3. The heating element of claim 1, wherein the member is tubular and comprises quartz glass.

4. The heating element of claim 1, wherein the member is non-tubular and comprises quartz glass.

5. The heating element of claim 1, wherein the coating comprises a doped metal oxide.

6. The heating element of claim 5, wherein the doped metal oxide comprises tin oxide.

7. The heating element of claim 1, wherein the coating is disposed onto the major surface utilizing a rotating fixture.

8. The heating element of claim 1, wherein the coating is disposed onto the major surface utilizing chemical vapor deposition.

9. The heating element of claim 1, wherein the coating is disposed onto the major surface utilizing spray pyrolysis.

10. The heating element of claim 1, wherein the coating has a nominal sheet resistance of about 25 ohms per square.

11. The heating element of claim 1, wherein each connection comprises a compression fining with wire mesh.

12. The heating element of claim 1, wherein each connection comprises a conductive metal bus bar.

13. The heating element of claim 12, wherein the bus bars comprise ceramic silver frit.

14. The heating element of claim 12, wherein the bus bars comprise sprayed copper.

15. The heating element of claim 14, wherein the sprayed copper is disposed on the conductive coating utilizing a heating head and mask apparatus.

16. The heating element of claim 1, wherein the connections are in electrical communication with an external power source.

* * * * *

UNITED STATES PATENT AND TRADEMARK OFFICE

CERTIFICATE OF CORRECTION

PATENT NO. : 7,003,220 B2
APPLICATION NO. : 10/990699
DATED : February 21, 2006
INVENTOR(S) : Peter F. Gerhardinger It is certified that error appears in the above-identified patent and that said Letters Patent is hereby corrected as shown below:

Column 6,
Line 10, "fining" should read -- fitting --.

Signed and Sealed this

Twenty-seventh Day of June, 2006

JON W. DUDAS
*Director of the United States Patent and Trademark Office*